US005669610A

United States Patent [19]

Salyers

[11] Patent Number: 5,669,610

[45] Date of Patent: Sep. 23, 1997

[54] HUMAN ASSAILANT SIMULATOR TARGET

[76] Inventor: Edward Francis Salyers, 517 Merwin Rd., Apollo, Pa. 15613

[21] Appl. No.: 561,540

[22] Filed: Nov. 22, 1995

[51] Int. Cl.[6] ..... F41J 1/00

[52] U.S. Cl. ..... 273/407; 273/406; 273/408; 273/403

[58] Field of Search ..... 273/403–410, 273/381, 378

[56] References Cited

U.S. PATENT DOCUMENTS

| | | | |
|---|---|---|---|
| D. 214,896 | 8/1969 | D'Agostino | D22/15 |
| 877,622 | 1/1908 | Wiborgh | 273/408 |
| 2,344,829 | 3/1944 | McAvoy | 273/406 |
| 2,920,893 | 1/1960 | Walker | 273/101 |
| 3,536,232 | 10/1970 | Lightcap | 222/5 |
| 4,203,600 | 5/1980 | Brown | 273/407 |
| 4,373,733 | 2/1983 | Smith, Jr. | 273/381 |
| 5,221,092 | 6/1993 | Simons, Jr. et al. | 273/407 |

FOREIGN PATENT DOCUMENTS

| | | | |
|---|---|---|---|
| 21295 | 4/1905 | Austria | 273/407 |
| 579050 | 1/1994 | European Pat. Off. | 273/407 |
| 2618534 | 11/1977 | Germany | 273/406 |
| 485040A | 5/1992 | Germany | F41J 1/01 |
| 1598566 | 9/1981 | United Kingdom | F41J 7/00 |

*Primary Examiner*—Mark S. Graham
*Attorney, Agent, or Firm*—Curtis V. Harr

[57] ABSTRACT

A Human Assailant Simulator Target for firearms training is disclosed. This target consists of a wire frame torso which may be supplied with arms and legs or used without limbs. The target frame may then be fitted with a bullet strike recorder paper having human vital areas or various targets imprinted thereon. Furthermore this paper may easily and inexpensively be replaced. The users of the target may then fit the target with clothes, facial features, hair wigs, masks, or various articles to simulate a person carrying weapons and or goods. The use of the wire frame provides a target that is ninety-eight percent open space in the primary bullet impact area, while the recorder paper allows a user to check accuracy, and quickly renew the target for the next user, while still giving a realistic target for practice.

10 Claims, 7 Drawing Sheets

HUMAN ASSAILANT SIMULATOR TARGET

BACKGROUND OF THE INVENTION

The present invention relates to the art of firearm combat training and more specifically to firearm targets. A target that is human in appearance is often used when training individuals in the art of accurately shooting firearms. These individuals could include members of a police force, individuals working as armed guards, military services, or private citizens training for self defense reasons. The use of a human form target allows the trainee to react and use their firearm as though facing a real human assailant.

With this purpose in mind, prior targets used for this type of training were made from solid materials such as plastic, wood, or metal. The problem with the method of construction of prior targets is that they quickly become useless as the primary target area, being rigidly integral with the entire device, becomes shot away due to repeated bullet impacts. This then requires that the user either repair the damaged targets or replace them. The cost of repeatedly replacing these targets can be substantial, and in repairing them the user incurs not only costs for replacement materials, but also a substantial amount of down-time to effectuate such repairs.

The problems of replacement cost and down-time are enhanced when the targets are deployed on a moving track system. These systems are often used to increase an individual's reaction time and to train one by shooting at moving targets. Additionally, these systems are used to increase an individual's ability to distinguish between "shoot" and "do not shoot" targets by randomly placing, in the sequence, a target obviously dressed as an innocent bystander. When the problems of target destruction described above occur, the use of a moving track increases the down-time and costs of repairing or replacing the targets due to the increase in the complexity of the system.

The present invention makes insignificant the destruction of the target's primary bullet impact area, as that area is ninety-eight percent open space. The target's large amount of open space is a result of having its structural components substantially separated from the impact area, further these components comprise a minor fraction of the target's total area. This allows the user to utilize the same target for an extended period of time while simply replacing inexpensive articles, such as clothing which may be used or worn-out to begin with and bullet impact recording paper which may be affixed to the target as needed. Both materials are thin, flexible and without rigid connection to the structure, thereby, presenting minimal resistance to a penetrating bullet. The obvious advantage to this is that the costs of replacing these items and the time required to do so are minimal. Another advantage that the present invention has over the prior art is that in the unlikely event that one of the frame members is damaged by a bullet impact it can, on site, be easily reshaped or quickly and cheaply replaced with another. Further if repairs are necessary separated pieces my be simply rejoined with a spare oval sleeve connector.

The present invention further enhances the effectiveness of the moving target systems by reducing the need to replace or repair individual targets. This allows the moving target system to be used more often and for longer periods of time, without the need for stopping to effectuate repairs.

SUMMARY OF THE INVENTION

Accordingly, it is the principle object of the present invention to provide a low cost, low maintenance target for combat firearm training that is not subject to the problem of destruction from bullet impacts, and further presents a realistic target.

Another object of the present invention is to provide a combat training target that may be used with a system that moves various targets around a track in order to more realistically simulate actual combat. More specifically, to provide a target that is less expensive and easier to repair and replace when used with such a system.

The Human Assailant Simulator Target accomplishes these objectives by providing a target that comprises a wire frame that the users may fit with clothes, facial features, hair wigs and or bullet strike recorder paper. The use of the wire frame provides a target that is ninety-eight percent open space in the primary bullet impact area.

The main component of this Human Assailant Simulator Target is the frame. The frame is composed of individual parts, made of heavy wire (such as ten gauge) or standard steel rod stock (such as ⅛ diameter), that are attached to each other by means of oval sleeve joiners, so as to describe the outline of a human form when so attached. Wire limbs, of similar material, may further be attached to the torso of the target with spirally coiled springs, or rubber or plastic tubing of an appropriate inside diameter, to give a realistic movement. The ends of the arms may be equipped with holders, or themselves formed to different shapes for the placement of various articles thus, giving the appearance of a target having a gun or a camera, etc.

The torso area of the Human Assailant Simulator Target can be covered with a paper to record bullet strikes; this is usually a piece of paper having a printed target to match the vital organs of a human however, any type of unmarked paper may be used. This paper may be quickly and inexpensively replaced, on site, as needed.

With the paper in place over the wire frame the target may then be covered with clothing to represent a human assailant. As the target is used, one may open or remove the clothes to check the bullet strike recorder for the accuracy of one's shots. As needed the recorder paper and clothes may quickly be replaced. When in use, the same clothing may serve for a number of shooters with only the recorder paper containing each shooter's hits, name and date, being changed. For a better understanding of the present invention, reference should be made to the drawings in which there is illustrated and described preferred embodiments of the present invention.

DESCRIPTION OF THE PREFERRED EMBODIMENT

Figure 1:
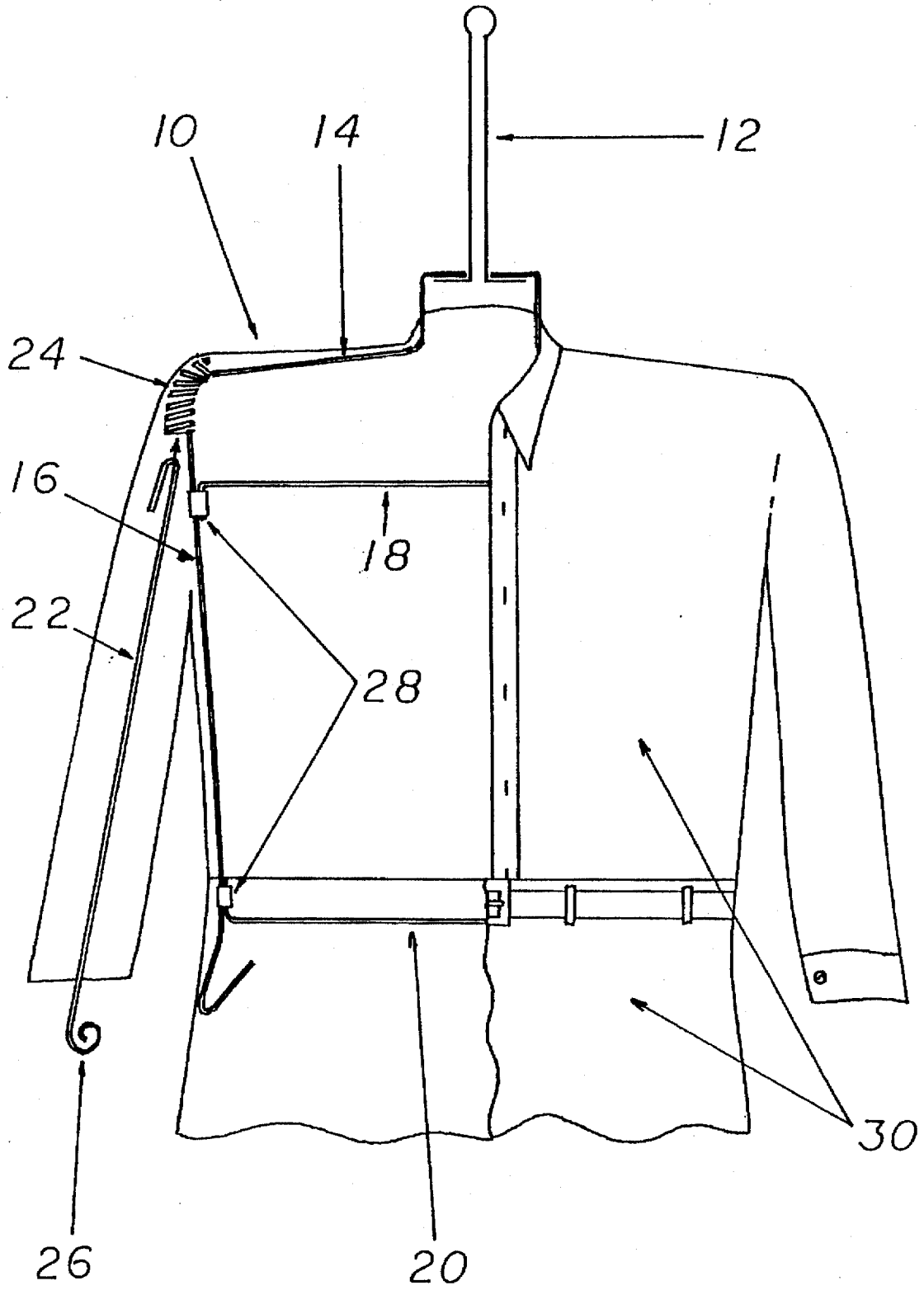
FIG. 1 is a front elevation cut-away view of the Human Assailant Simulator Target showing the orientation of its major components and how the target may be fitted with human clothing to accurately depict a human assailant.

As shown by FIGS. 1, 2, 3, 4, and 5 the Human Assailant Simulator Target 10 comprises wire frame members joined together in such a manner as to form the outline of a human shape. The shoulder sections 14 of the present invention attach at their furthest outside extremity to the torso side sections 16. This attachment point is also where, in this case, an arm retaining spirally coiled spring 24 is attached to the Human Assailant Simulator Target 10. The arm retaining spirally coiled spring 24 or the use of rubber tubing, provides for the attachment of the removable arm sections 22. The use of the arm retaining spirally coiled spring 24 facilitates the placing of a shirt, blouse or dress on the frame and further allows for the variable positioning of the coiled arm end 26 located at the end of the removable arm sections 22. The coiled arm end 26 is used to attach such things as weapons to the present invention to enhance its realism.

Also attached to the torso side sections 16 are the chest cross brace 18 and the waist cross brace 20. These two braces provide lateral support to the Human Assailant Simulator Target 10 and are attached to the torso side sections 16 through the use of oval sleeve wire connectors 28. The hanger/head form support 12 is attached at the inner most end of the shoulder sections 14 and provides for the anchoring of the Human Assailant simulator Target 10 at its top when in use.

FIG. 1 shows the use of the Human Assailant Simulator Target 10 as used with clothing 30 to enhance the realism of the target. This figure depicts how the center area of the target is virtually empty space and that the key elements of the target, the shoulder sections 14, the torso side sections 16, the chest cross brace 18, and the waist cross brace 20, are only slightly exposed to damage from bullet impacts.

Figure 2:
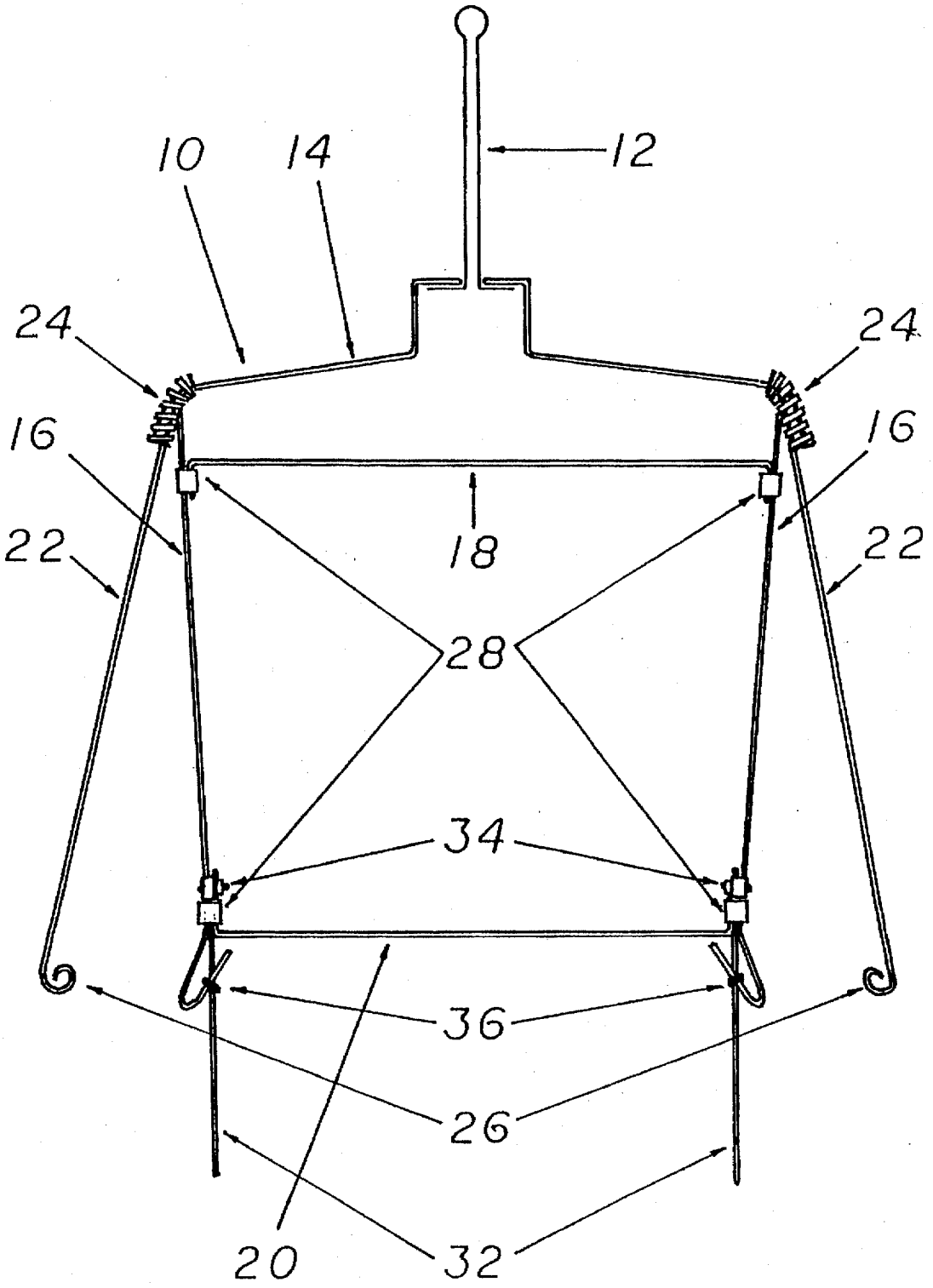
FIG. 2 is a front elevation view of the present invention showing the orientation of its major components and the manner in which they are attached to one another. This figure also shows the attachment of the optional leg rods and the manner in which that attachment is accomplished.

As shown by FIG. 2, the frame sections of the Human Assailant Simulator Target 10 are constructed in a symmetrical manner. Therefore, the shoulder sections 14, the torso side sections, the removable arm sections 22, the arm retaining spirally coiled springs 24, the coiled arm ends 26, the oval sleeve wire connectors 28, the leg rods 32, the leg rod stops 34, and leg rod to frame attachment wire 36, are interchangeable as to either side of the present invention. The hanger/head form support 12, the chest cross member 18, and waist cross member 20 span the center of the Human Assailant Simulator Target 10.

This figure also shows the attachment of the optional leg rods 32 and their attachment to the present invention through the use of the leg rod stops 34, which are attached to the lower end of the torso side sections 16, and leg rod to frame attachment wire, which is also fixed to the lower end of the torso side sections 16. The purpose of the leg rods 32 is to allow the Human Assailant Simulator Target 10 to be anchored in place at its bottom by inserting the rods into the ground or into a base device which has been pre drilled or otherwise prepared to accept them.

Figure 3:
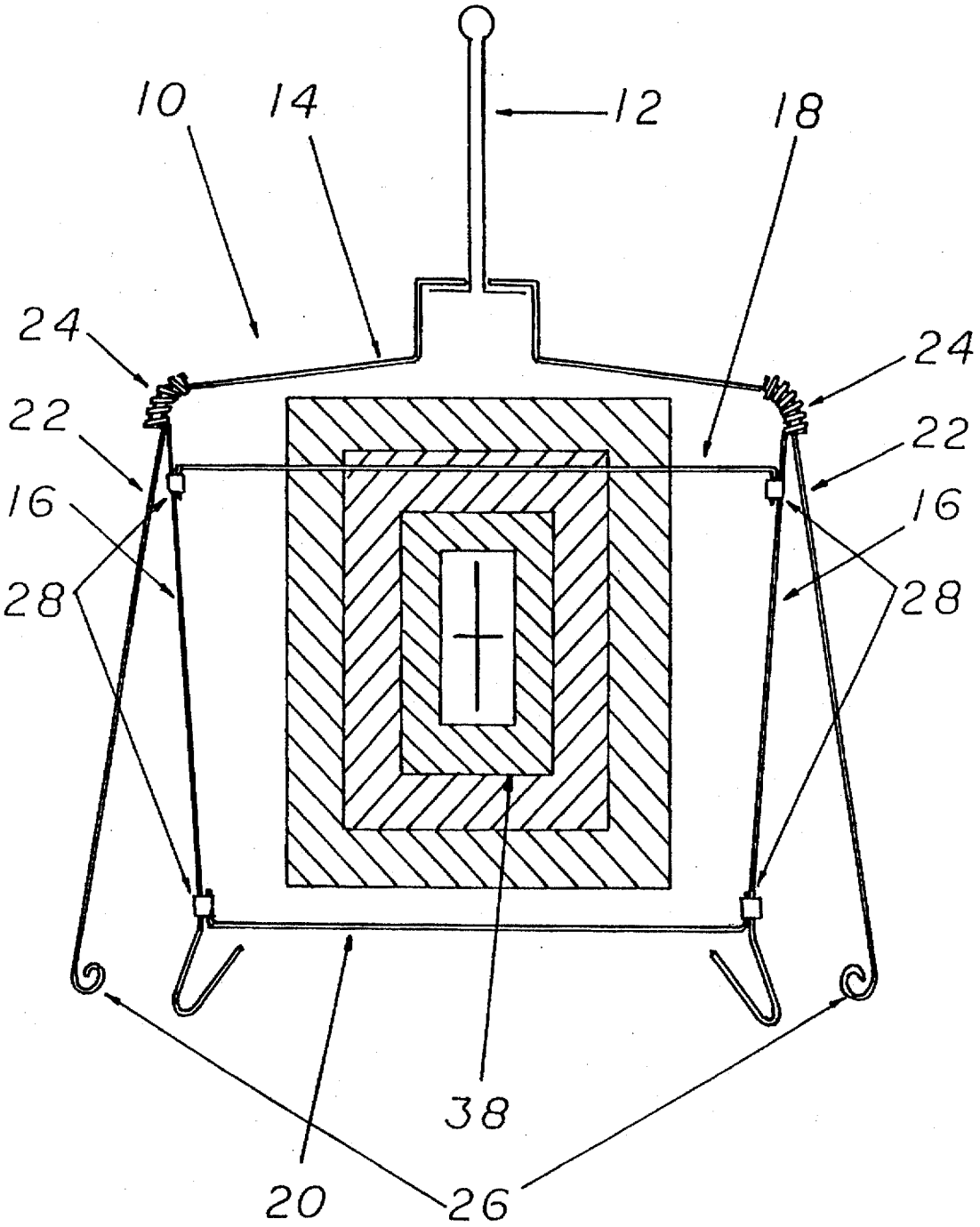
FIG. 3 is a front elevation view of the present invention showing the area that is most subject to bullet impacts being defined by the boxed in areas depicted within the frame of the target.

FIG. 3 is a graphic representation of the area of the Human Assailant Simulator Target 10 which is most subject to bullet impacts 38. This illustrates the fact that the individual frame members of said invention are specifically designed to be in an area of the target that is rarely subject to bullet impacts. The frame members occupy only a fractional portion of the total target area, significantly reducing their probability of being struck in any given number of shots fired, and thereby substantially limiting the need to repair or replace the damaged sections.

Figure 4:
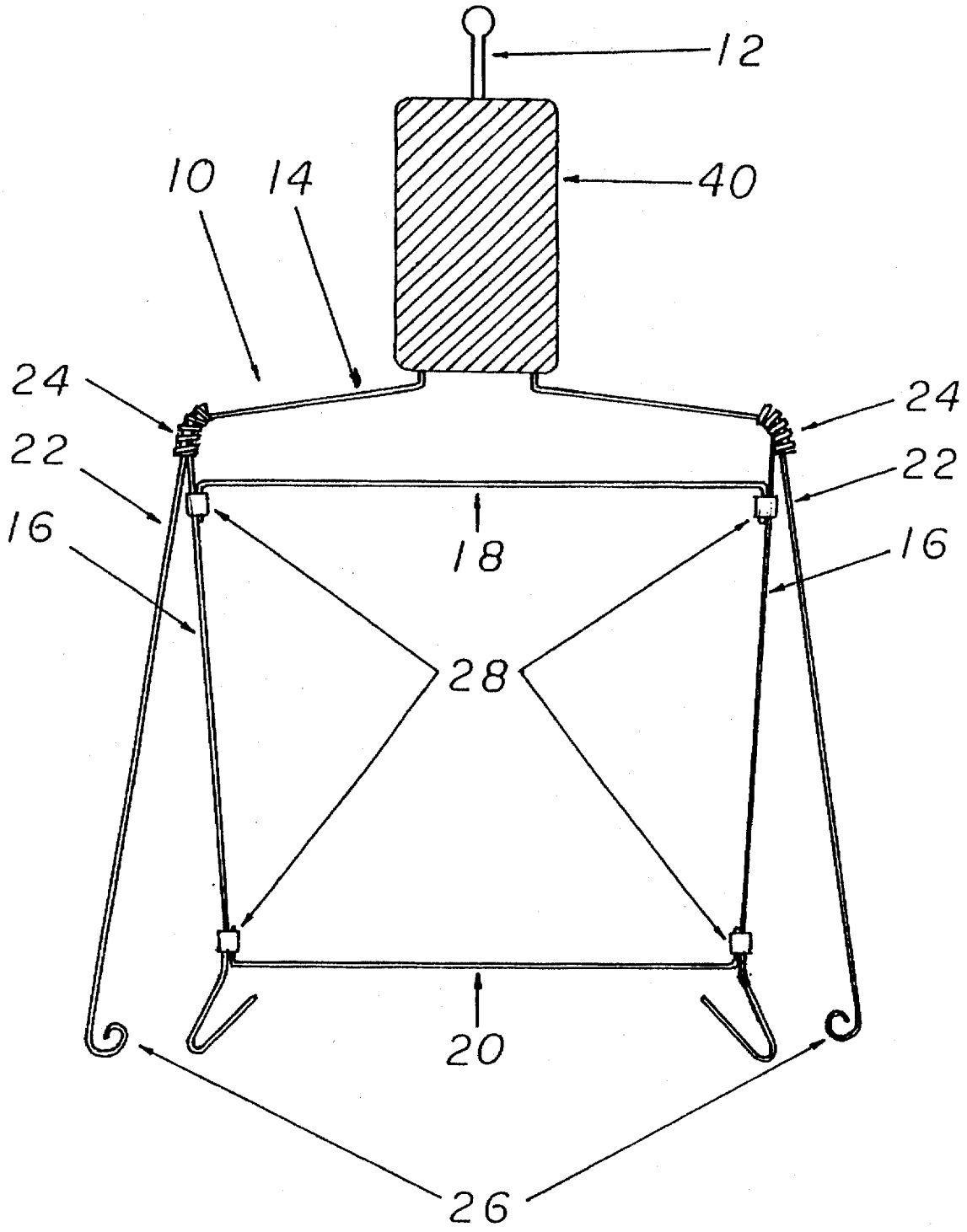
FIG. 4 is a front elevation view of the Human Assailant Simulator Target showing a head form being attached to the top of the frame.

As shown by FIG. 4, a head form 40 may be fitted over the hanger section 12 of the Human Assailant Simulator Target 10. This feature adds to the realism of said target and can be used as a target area. The material typically used for the head form 40 is an empty plastic container, like a one-gallon bleach bottle which has been cut off at its neck end and having a hole cut on center, in its bottom surface, and inserted in an inverted position over the hanger section 12 and down to the shoulder sections 14 of the present invention. The head form 40 may also be a commercially available Styrofoam wig storing form, pierced on center from bottom to top, to accept the head/hanger section 12.

Figure 5:
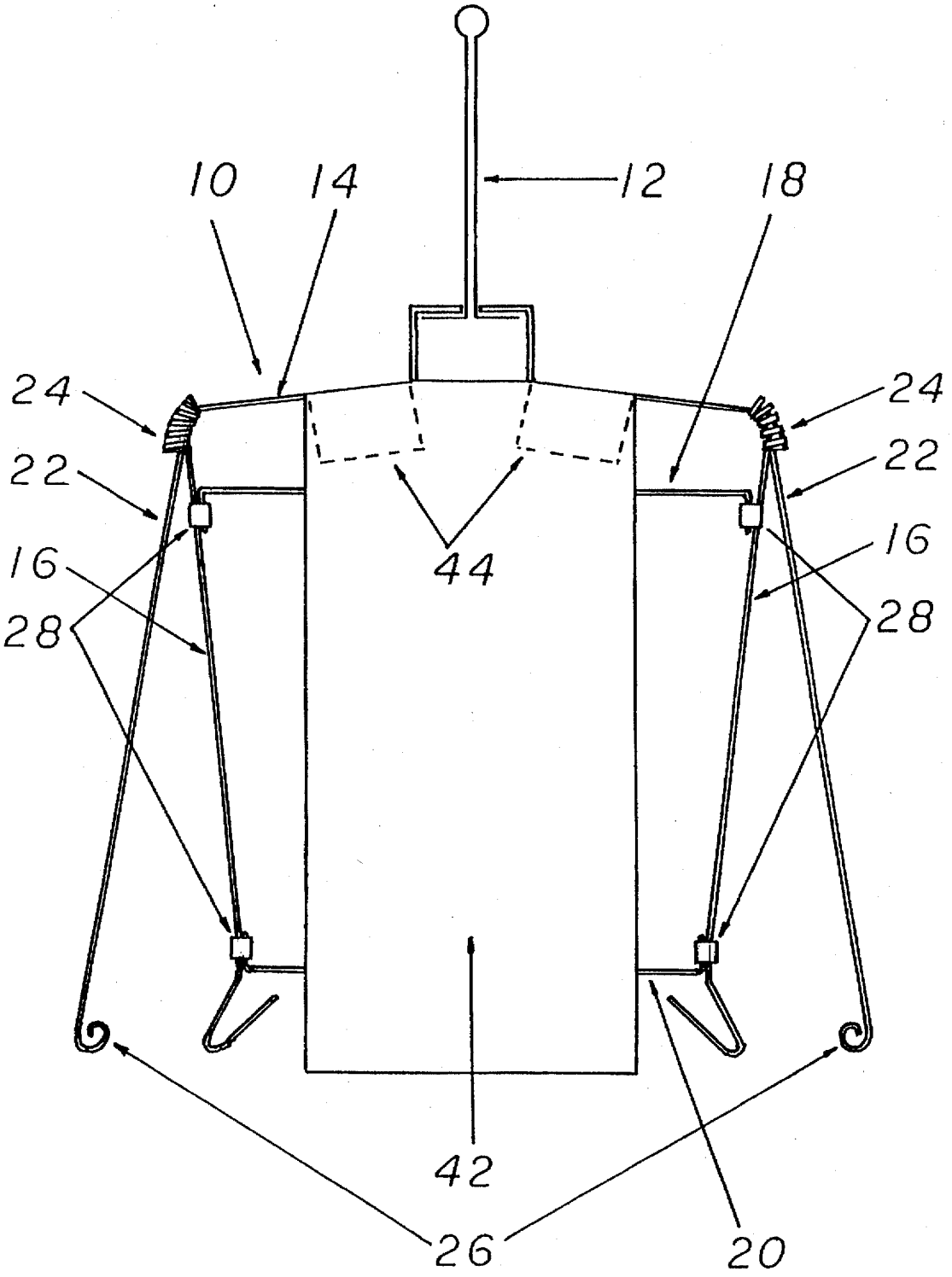
FIG. 5 is a front elevation view of the present invention showing the placement of bullet impact recording paper over the frame of the target.

As shown by FIG. 5, the Human Assailant Simulator Target 10 may also be fitted with a paper bullet strike recorder 42 which is folded over the shoulder sections 14 and held in place by the paper impact recorder securing tabs 44. This feature is used to indicate the accuracy of the user by recording strikes between the chin and pelvis during practice and is inexpensively and easily replaced. It may also be used in conjunction with the realism aids of the Human Assailant Simulator Target 10.

Figure 6:
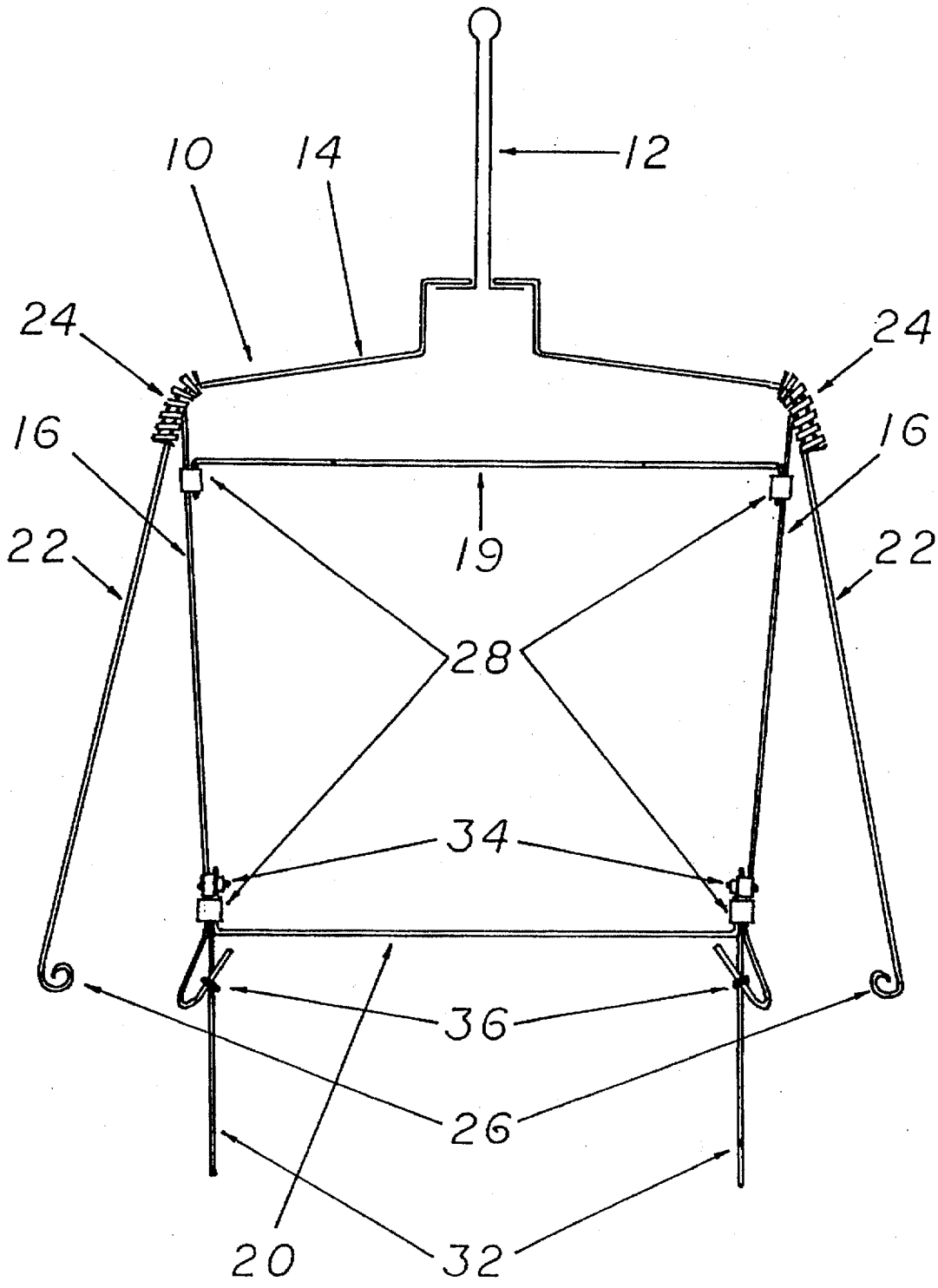
FIG. 6 is a front elevation view of the present invention showing the orientation of the three dimensional cross brace to the other major components.
Figure 7:
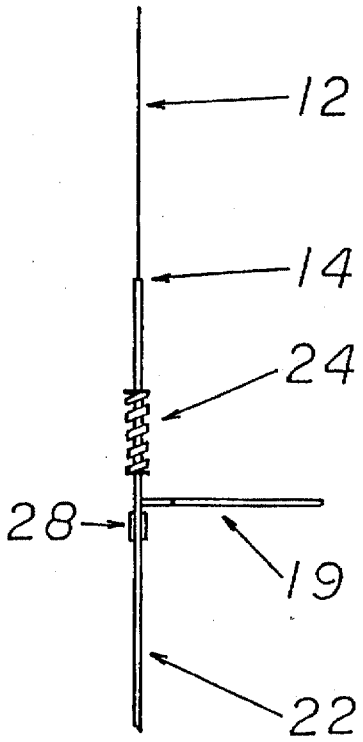
FIG. 7 is a side elevation view of showing the manner in which the three dimensional cross brace extends outward from the vertical plane of the present invention.
Figure 8:
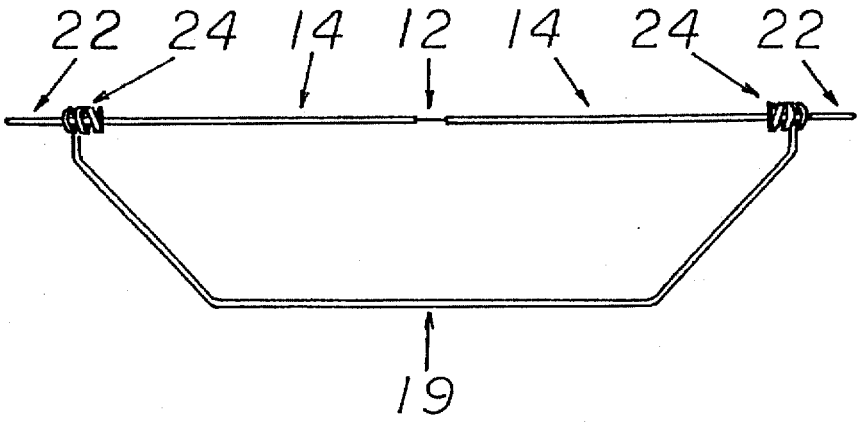
FIG. 8 is a top elevation view showing again how the three dimensional cross brace extends outward from the vertical plane of the present invention.

Another variation of the present invention is to fit it with a three dimensional cross brace 19 located in the chest area as shown by FIGS. 6, 7, and 8. In this configuration, the three dimensional cross brace 19 is used in place of the chest cross brace 18 and is mounted to the torso side sections 16 by means of the oval sleeve wire connectors 28. This feature provides the necessary lateral support to the frame of the Human Assailant Simulator Target 10 while giving it a three dimensional quality which serves to enhance the realism to the user.

Although the present invention has been described in considerable detail with reference to certain preferred version thereof, other version are possible. Therefore, the spirit and scope of the appended claims should not be limited to the description of the preferred version contained herein.

I claim:

1. A hollow frame target for shooters comprising a human shaped wire frame torso, said torso being defined by an upper shoulder section, a lower waist section and a pair of side sections;

a hanger/head form support section fixably attached to said upper shoulder section;

an impact recorder means attached across said wire frame torso; and a set of human clothing covering said impact recorder means.

2. A hollow frame target for shooters as in claim 1 wherein said impact recorder means is a paper impact recorder.

3. A hollow frame target for shooters as in claim 2 wherein said paper impact recorder is preprinted.

4. A hollow frame target for shooters comprising a human shaped wire frame torso, said torso being defined by an upper shoulder section, a lower waist section and a pair of side sections:

a hanger/head form support fixably attached to said upper shoulder section;

an impact recorder means attached across said wire frame torso;

a pair of wire arms having holders at one end;

a means of movably attaching said wire arms to said wire frame torso; and a set of human clothing covering said wire frame torso and said wire arms.

5. A hollow frame target for shooters as in claim 4 wherein said means of movably attaching said wire arms to said wire frame torso is a spirally coiled spring or a length of flexible tubing.

6. A hollow frame target for shooters as in claim 5 wherein said impact recorder means comprises a paper bullet strike impact recorder.

7. A hollow frame target for shooters comprising a human shaped wire frame torso, said torso being defined by an upper shoulder section, a lower waist section and a pair of side sections:

a hanger/head form support fixably attached to said upper shoulder section;

an impact recorder means attached across said wire frame torso;

a pair of wire arms having holders at one end;

a means of movably attaching said wire arms to said wire frame torso;

a pair of legs;

a means of attaching said legs to said wire frame torso; and a set of human clothing covering said wire frame torso, said wire arms and said legs.

8. A hollow frame target for shooters as in claim 7 wherein said means of attaching said wire legs to said wire frame comprises a pair of leg rod stops and wire attachment pieces.

9. A hollow frame target for shooters as in claim 8 wherein said means of movably attaching said wire arms to said wire frame torso is a spirally coiled spring or length of flexible tubing.

10. A hollow frame target for shooters as in claim 9 wherein said impact recorder means comprises a paper bullet strike recorder.

* * * * *